United States Patent [19]

Takamura

[11] Patent Number: 4,622,802

[45] Date of Patent: Nov. 18, 1986

[54] METHOD OF PACKING ARTICLES

[75] Inventor: Yoshiyuki Takamura, Nagoya, Japan

[73] Assignee: Fuji Pack System Ltd., Nagoya, Japan

[21] Appl. No.: 776,733

[22] Filed: Sep. 17, 1985

[51] Int. Cl.[4] ..... B65B 11/22

[52] U.S. Cl. ..... 53/466; 53/441; 53/228; 53/556

[58] Field of Search ..... 53/441, 465, 466, 206, 53/210, 222, 228, 229, 556

[56] References Cited

U.S. PATENT DOCUMENTS

| | | | |
|---|---|---|---|
| 3,267,642 | 8/1966 | Broadbent | 53/228 |
| 3,650,087 | 3/1972 | Brinkmeier | 53/228 X |
| 3,683,586 | 8/1972 | Duckhinsky | 53/228 |
| 3,747,295 | 7/1973 | Brinkmeier | 53/228 X |
| 3,816,969 | 6/1974 | Zimmerman | 53/210 X |
| 3,908,337 | 9/1975 | Zimmerman | 53/206 |
| 3,967,433 | 7/1976 | Bonfiglioli | 53/441 |
| 4,033,089 | 7/1977 | Byland | 53/210 |

FOREIGN PATENT DOCUMENTS

| | | | |
|---|---|---|---|
| 2410601 | 8/1979 | France | 53/228 |
| 278806 | 10/1951 | Sweden | 53/210 |

*Primary Examiner*—John Sipos

*Attorney, Agent, or Firm*—Jordan and Hamburg

[57] ABSTRACT

Disclosed is a method of packing an article which comprises the steps of: stretching and gripping a packing film; sending an article onto a reception block having a turning belt for mounting the article thereon, under the packing film; moving up the article together with the reception block so as to urge the article against the packing film; moving thereafter the reception block and a tuck block situated in an article send-in side of the reception block, to an article send-out side of the same, thereby shifting the article from the reception block to the tuck block, the packing film being put in a state where one end portion of the packing film is extended down through a gap between the reception block and the tuck block and gripped thereat, in shifting the article; moving a mounting portion of the belt of the reception block in a direction opposite to the direction of movement of the reception block and the tuck block, in shifting the article; and tucking-in the one end portion of the packing film under the article owing to the movement of the mounting portion.

11 Claims, 9 Drawing Figures

METHOD OF PACKING ARTICLES

BACKGROUND OF THE INVENTION

1. Field of the Invention

The present invention relates to a method of packing an article, in which packing is performed such that a packing film is made cylindrical to roll an linear article such as a cucumber, or the like, and the opposite end opening portions of the cylindrical packing film are tucked in under the article.

2. Description of the Prior Art

In the field of packing technique of this kind, there have been no methods to perform packing mechanically, speedy, and efficiently.

SUMMARY OF THE INVENTION

An object of the present invention is to provide a method of packing an article, in which the article can be packed in a packing film mechanically and efficiently.

Another object of the present invention is to provide a method of packing an article, in which even a soft article such as a vegetable, a fruit, or the like, can be packed without injuring the article, and therefore in which any tray for mounting the article thereon is disused.

To attain the foregoing objects of the present invention, the method of packing an article comprises the steps of: stretching and gripping a packing film; sending an article onto a reception block having a turning belt for mounting the article thereon, under the packing film; moving up the article together with the reception block so as to urge the article against the packing film; moving thereafter the reception block and a tuck block situated in an article send-in side of the reception block, to an article send-out side of the same, therey shifting the article from the reception block to the tuck block, the packing film being put in a state where one end portion of the packing film is extended down through a gap between the reception block and the tuck block and griped thereat, in shifting the article; moving a mounting portion of the belt of the reception block in a direction opposite to the direction of movement of the reception block and the tuck block, in shifting the article; and tucking-in the one end portion of the packing film under the article owing to the movement of the mounting portion.

Other and further objects of the present invention will become obvious upon an understanding of the illustrative embodiments about to be described or will be indicated in the appended claims, and various advantages not referred to herein will occur to one skilled in the art upon employment of the invention in practice.

DETAILED DESCRIPTION OF THE PREFERRED EMBODIMENTS

Figure 1:
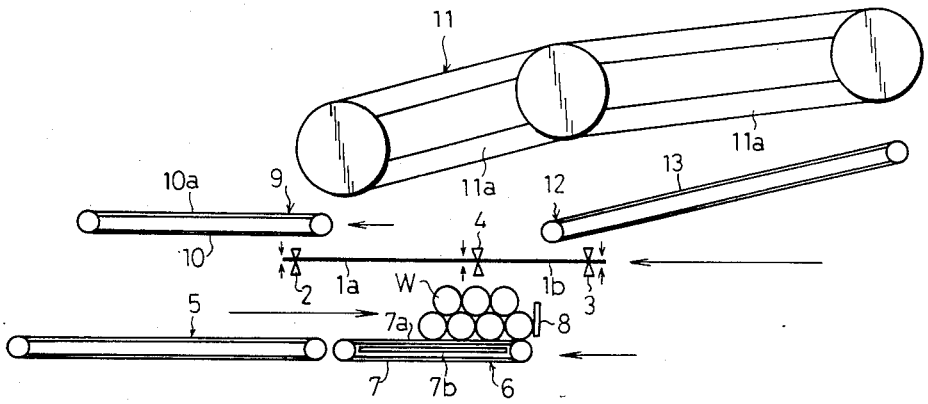
FIGS. 1 to 4 are diagrams showing the operations of tucking-in one end portion of a packing film.

An embodiment of this invention will be described in detail hereunder by referring to the drawings. Although not shown, a belt-like packing film is drawn from a take-up roll by a transporting device, and cut off with a predetermined length. Thereafter, as shown in FIG. 1, the cut packing film 1 is gripped at the four sides thereof by front and rear gripping members 3 and 2 and left and right gripping members 4 (only one shown) and stretched at a level. In synchronism with stretching and gripping of the packing film, an article W is shifted from an article supply block 5 which is able to be turned forcedly (a flat belt is used in this embodiment) onto a reversibly movable flat belt 7 of a reception block 6 disposed under the packing film 1, and the article W is stopped when it abuts against a stopper 8. An article mounting portion 7*a*, that is an upper portion of the flat belt 7, is supported by a supporting member 7*b* (a plate member or a group of rollers) so that it is prevented from bending downward when the article W is loaded thereon.

Figure 2:
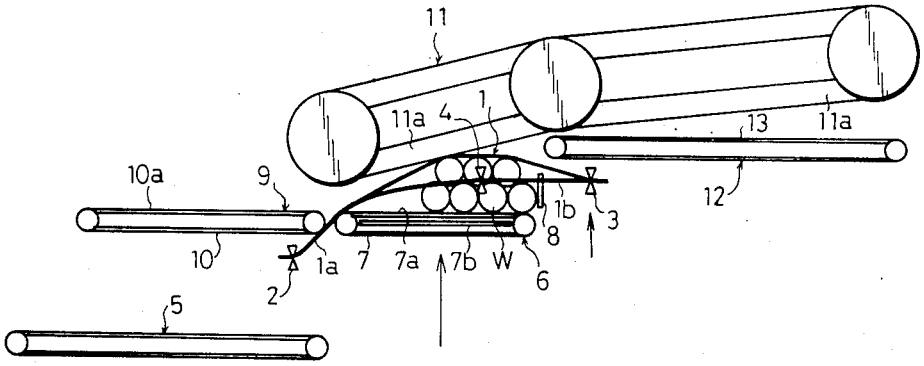

Thereafter, as shown in FIG. 2, the reception block 6, the stopper 8, the left and right gripping members 4, the front gripping member 3, and a discharge block 12 disposed above the front gripping member 3 are caused to come up, and the article W on the reception block 6 is pressed up toward the packing film 1. The pressed-up article W is urged against the packing film 1 so as to lift up the latter, and pressed by a sponge belt 11*a* of a transporting device 11 disposed above the discharge block 12. The transporting device 11 is arranged to be movable upward/downward and to be able to tilt.

Figure 3:
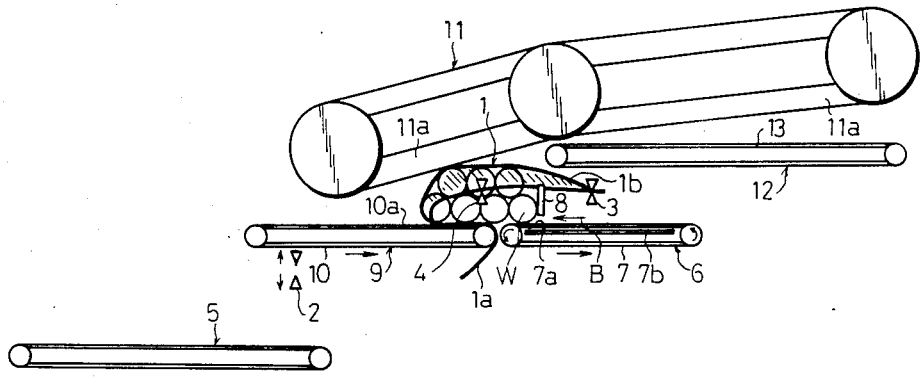
Figure 4:
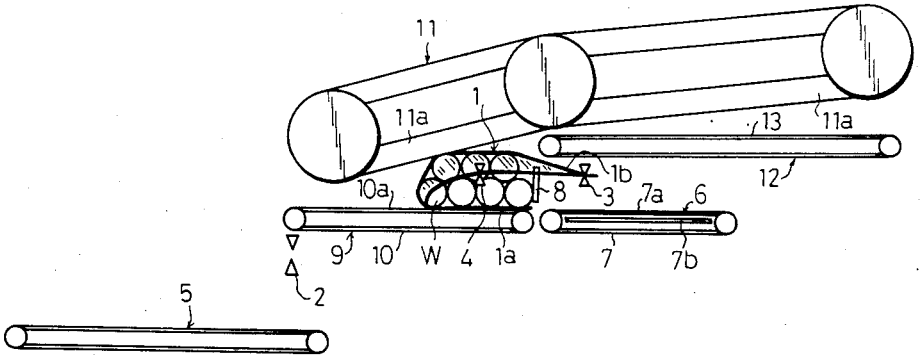
Figure 5:
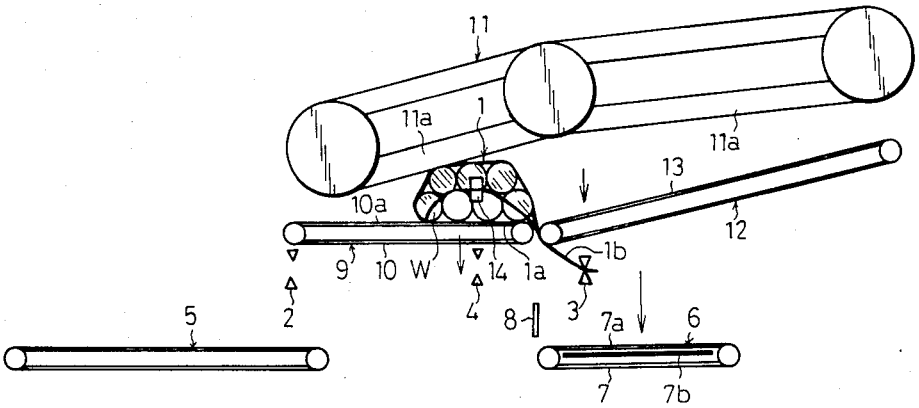
FIGS. 5 and 6 are diagrams showing the operations of tucking-in the other end portion of the packing film.

Next, as shown in FIG. 3, above the rear gripping member 2, the reception block 6 and a tuck block 9 disposed adjacent to the reception block 6 are moved forward. Further, the flat belt 7 of the reception block 6 is forcedly turned and the mounting portion 7*a* thereof is moved backward. In moving them, as the article is shifted from the reception block 6 to the tuck block 9, a rear end portion 1*a* of the packing film 1 extended downward from a gap between the reception block 6 and the tuck block 9 and gripped by the rear gripping member 2 is tucked-in under the article W as shown in FIG. 4 with the grip released. Thereafter, the article W is shifted onto a flat belt 10 of the tuck block 9, which is able to turn freely.

During the tucking-in operation, as the reception block 6 and the tuck block 9 are moved forward, the mounting portion 7*a* of the flat belt 7 of the reception block 6 is moved backward. At this time, the mounting portion 10*a* of the flat belt 10 of the tuck block 9 is also moved backward, so that the forward movement of the reception block 6 and the tuck block 9 and the rearward movement of the mounting portions 7*a* and 10*a* of the respective blocks 6 and 9 are cancelled with each other. Therefore, no forward/backward slide occurs between the article W and each of the flat belts 7 and 10. At this time, the article W may slide forward by a tucking-in force. To prevent the article W from sliding against the tucking-in force, the flat belt 7 of the reception block 6 is forcedly turned. Since the tucking-in force is not so large at the beginning of shifting the article W onto the flat belt 10 of the tuck block 9, the flat belt 10 of the tuck block 9 is able to turn freely without requiring forced turning.

Packing resistance varies depending on the kind of packing film 1 and other packing conditions. When the packing resistance is little, both the flat belt 7 of the reception block 6 and the flat belt 10 of the tuck block 9 may be made so as to be able to turn freely, while when the packing resistance is large, not only the flat belt 7 of the reception block 6 but also the flat belt 10 of the tuck block 9 may be made so as to be able to turn forcedly. In short, it is necessary to cause the flat belts 7 and 10 to turn freely or to adjust the peripheral speed of each of the flat belts 7 and 10 in the case of forced turning, in accordance with the friction power generated between the article W and each of the flat belts 7 and 10, so that the transition in relative position between the article W and each of the flat belts 7 and 10 is made as less as possible.

When the article W is shifted onto the flat belt 10 of the tuck block 9, the rear end portion 1*a* of the packing film 1 has already been tucked in under the article W. Therefore, the article W is brought into contact with the flat belt 10 through the rear end portion 1*a* thereof, that is, the article W never touches the flat belt 10 in direct. Accordingly, not so significant problem is caused in the point of injuring the article W even if the transition in relative position arises more or less between the article W and the flat belt 10. Since the article W touches the flat belt 7 of the reception block 6 directly, on the contrary, it is important to suppress the transition in relative position therebetween as less as possible. To prevent the article W from being injured as much as possible in the case where any transition arises more or less in relative position between the article W and each of the mounting portions 7*a* and 10*a*, it is desired that the mounting portions 7*a* and 10*a* have no uneven portions. Accordingly, the flat belt 7 is used in the embodiment of the invention.

Since no significant problem occurs in the point of injuring the article W on the tuck block 9 as described above, the flat belt 10 may be replaced by a plurality of rollers. Although a slight problem may arise in the point of injury depending on the kind of the article W, the flat belt 7 of the reception block 6 may be replaced by a plurality of rollers.

Figure 6:
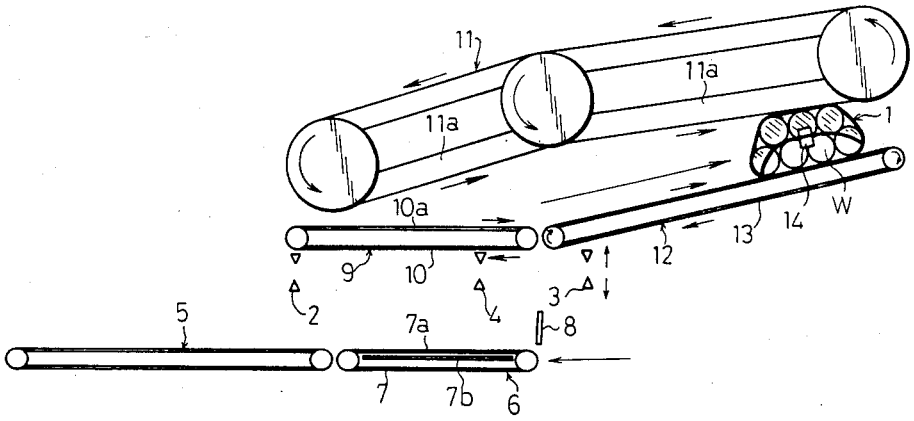

After the rear end portion 1*a* of the packing film 1 has been tucked in as described above, the reception block 6, the stopper 8, the front gripping member 3, and the discharge block 12 are caused to descend. As those component elements descend, the packing film 1 is gripped by a pair of movable gripping members 14 which reciprocates along the discharge block 12, and at the same time, the left and right gripping members 4 descend with the grip released. Next, the article W is shifted onto a plurality of forced-turn round belts 13 of the discharge block 12 by the transporting device 11 which presses down the article W with the sponge belt 11*a* thereof. Accordingly, the front end portion 1*b* of the packing film 1 extended downward from a gap between the tuck block 9 and the discharge block 12 and gripped by the front gripping member 3 is tucked in under the article W and under the rear end portion 1*a* of the packing film 1 with the grip released. After tucking-in, the packing film 1 becomes cylindrical so that the article W is rolled upon the round belts 13 of the discharge block 12 as shown in FIG. 6. In synchronism with the tucking-in of the front end portion 1*b*, the reception block 6 moves toward the article supply block 5 and then assumes a posture of standing by till the article is shifted thereto.

In tucking-in the front end portion 1*b* of the packing film 1, the transporting device 11 may be disused and the tuck block 9 and the discharged block 12 may be moved backward relatively to the article W located at a predetermined position in the same manner as the tucking-in of the rear end portion 1*a* of the packing film 1.

Figure 7:
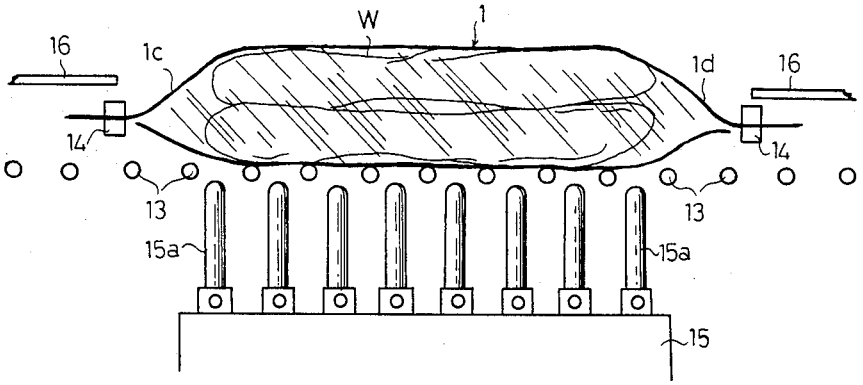
FIGS. 7 to 9 are diagrams showing the operations of tucking-in the opposite end opening portions of the packing film which is made cylindrical by rolling around an article.
Figure 8:
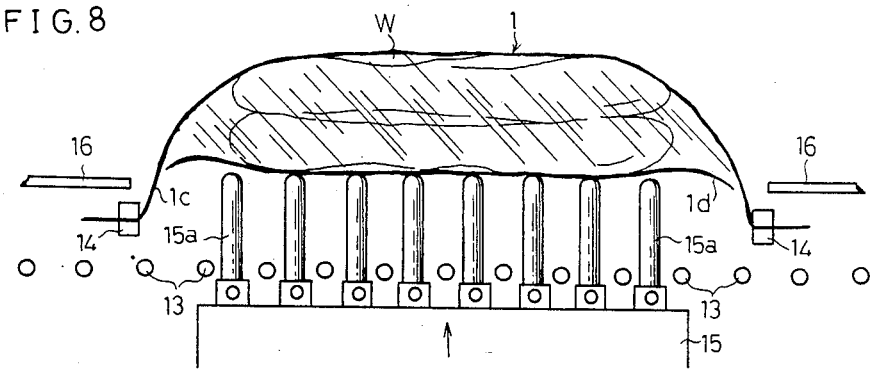
Figure 9:
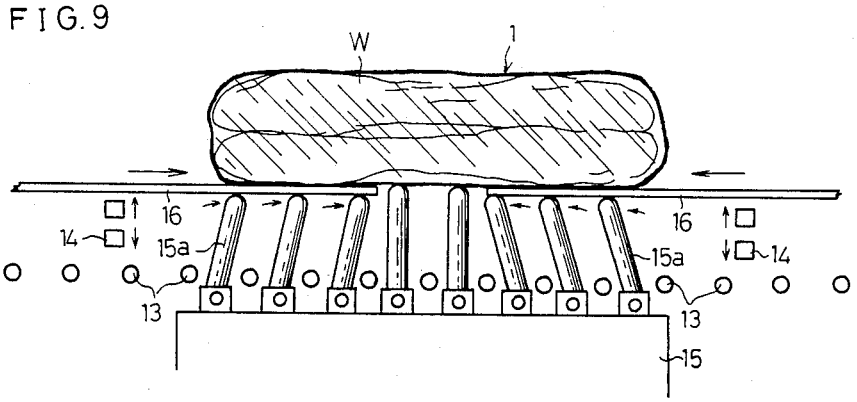

Next, a press-up block 15 disposed under the round belts 13 of the discharged block 12 as shown in FIG. 7 ascend as shown in FIG. 8. A plurality of elastic yielding rods 15*a* of the press-up block 15 pass through among the round belts 13 of the discharge block 12, and the article W on the round belts 13 is lifted. A pair of tucking members 16 enter under the article W while pulling down the yielding rods 15*a* of the press-up block 15 against the elasticity of the rods as shown in FIG. 9. Accordingly, with releasing the grip of the movable gripping members 14, the opposite end opening portions 1*c* and 1*d* of the cylindrical packing film 1 are tucked in under the article W and under the opposite end portions 1*a* and 1*b* of the packing film 1, so that the article W is completely packed. Thereafter the packed article W is discharged backward by the discharge block 12 and the transporting device 11.

In synchronism with the tucking-in of the opposite end opening portions 1*c* and 1*d*, the tuck block 9 is returned to the state shown in FIG. 1, and at the same time, the shifting of the article W onto the reception block 6 and the stretching and gripping of the packing film 1 are performed, the next steps following thereafter.

According to the invention described above in detail, such an effect can be obtained that cylindrical packing of long and narrow articles can be performed mechanically, speedy, and efficiently.

As many apparently widely different embodiments of this invention may be made without departing from the spirit and scope thereof, it is to be understood that the invention is not limited to the specific embodiments thereof except as defined in the appended claims.

What is claimed is:

1. A method of packing an article, comprising:

placing an article to be wrapped on a reception block, said reception block having front and rear sides;

providing a packing film having front, rear and two side portions, said packing film being stretched above the article;

providing a tuck block having a front end, said tuck block being located so that the front end of the tuck block is at least situated above the rear portion of the packing film, and when the reception block is moved upwardly, the front end of the tuck block is situated adjacent to the rear side of the reception block;

providing a discharge block having a rear end, said discharge block being located so that the rear end of the discharge block is situated above at least the front portion of the packing film;

moving upwardly the reception block with the article thereon and at least the rear end of the discharge block so that the rear portion of the packing film extends downwardly between the tuck block and the reception block and the front portion of the packing film is located under the rear end of the discharge block;

moving the reception block and the tuck block toward the discharge block until the front end of the tuck block is located adjacent to the rear end of the discharge block so that the position of the article relative to the discharge block is not changed, whereby the rear portion of the packing film is located between an upper surface of the tuck block and the article;

moving the reception block and at least the rear end of the discharge block downwardly so that the front portion of the packing film extends downwardly between the front end of the tuck block and the rear end of the discharge block; and moving the article relative to the tuck block and the discharge block so that the front portion of the packing film is located between the article and the discharge block.

2. A method of packing an article according to claim 1, further comprising locating the two side portions of the packing film under the article after the front portion of the packing film is located between the article and the discharge block.

3. A method of packing an article according to claim 2, in which said locating the two side portions of the packing film under the article comprises lifting the article above the discharge block and inserting tucking members under the article from the two sides of the article so that the two side portions of the packing film are located under the article.

4. A method of packing an article according to claim 3, in which said locating the two side portions of the packing film under the article further comprises removing the tucking members under the article and lowering the article so that the article is located on the discharge block.

5. A method of packing an article according to claim 4, in which said lifting article above the discharge block is performed by means of a plurality of elastic yielding rods which pass through the discharge block when the article is to be lifted.

6. A method of packing an article according to claim 2, further comprising discharging the article from the discharge block, and moving the reception block and the tuck block to the first position.

7. A method of packing an article according to claim 6, further comprising providing gripping members for respectively holding the front, rear and two side portions of the packing film, said gripping members being firstly situated above the article for holding the packing film thereabove, the gripping members for holding the front and two side portions of the packing film being moved upwardly when the reception block and the rear end of the discharge block are moved upwardly, the gripping member for holding the rear portion of the packing film releasing the packing film when the tuck block and the reception block are moved toward the discharge block, the gripping members for holding the two side portions of the packing film releasing the packing film, the gripping members for holding the two side portions of the packing film and the gripping member for holding the front portion of the packing film being moved downwardly when the rear end of the discharge block and the reception block are moved downwardly, and finally the gripping member for holding the front portion of the packing film releasing the packing film.

8. A method of packing an article according to claim 6, in which said reception block includes a reception belt turning around the reception block, and the tuck block includes a tuck belt turning around the tuck block.

9. A method of packing an article according to claim 8, in which said moving the reception block and the tuck block toward the discharge block is performed while the article is held by means of a stopper, so that the reception belt and the tuck belt freely rotate relative to the reception block and the tuck block respectively and the position of the article relative to the discharge block is not changed.

10. A method of packing an article according to claim 8, in which said moving the reception block and the tuck block toward the discharge block is performed while the reception belt and the tuck belt are being turned so that the article is moved away from the discharge block, whereby the position of the article relative to the discharge block is not changed when the reception block and the tuck block are moved toward the discharge block.

11. A method of packing an article according to claim 6, further comprising providing a transporting device situated at lease above the discharge block, said transporting device transmitting the article on the discharge block outwardly.

* * * * *